United States Patent [19]

Mayberry

[11] 4,353,144

[45] Oct. 12, 1982

[54] UTILITY BRUSH

[76] Inventor: Sherry A. Mayberry, 1911 Pleasant Dr., Bastrop, La. 71220

[21] Appl. No.: 144,242

[22] Filed: Apr. 28, 1980

[51] Int. Cl.[3] ..... A46B 13/02

[52] U.S. Cl. ..... 15/246; 15/21 R; 15/DIG. 5; 15/56

[58] Field of Search ..... 15/21 R, 21 E, 24, 28, 15/23, 29, 104.1 R, 246, 246.5, 97 R, 56, 22 R, DIG. 5

[56] References Cited

U.S. PATENT DOCUMENTS

| | | | |
|---|---|---|---|
| 1,539,718 | 5/1925 | Crum | 15/56 |
| 3,150,399 | 9/1964 | Dick et al. | 15/56 X |
| 4,081,704 | 3/1978 | Vassos | 310/50 |
| 4,217,671 | 8/1980 | Rand | 15/24 |

*Primary Examiner*—Edward L. Roberts

[57] ABSTRACT

A utility brush for automatic cleaning of toilet bowls which includes a generally cylindrically-shaped housing containing a motor, and in a preferred embodiment, a timer, with a shaft coupled to the motor and extending through brackets in the housing to removably carry a tapered, generally cone-shaped brush projecting beneath the housing. The brush is "stepped" or shaped and configured to match the interior shape of toilet bowls for thorough cleaning, and the housing is provided with a mount bracket for removably securing the housing to the rim of the toilet bowls with the brush projecting downwardly inside the bowls. The brush is electrically operated and may be designed to rotatably clean the toilet bowls in multiple, timed sequences.

8 Claims, 5 Drawing Figures

UTILITY BRUSH

BACKGROUND OF THE INVENTION

1. Field of the Invention

Perhaps one of the most disagreeable tasks in the home is the periodic cleaning of toilet bowls in bathrooms. Conventional cleaning of toilet bowls is generally manually accomplished by means of hand-held brushes of various shapes, using cleaners or disinfectants. This cleaning is absolutely essential in the home for sanitary reasons, and considerable effort is necessary with a hand brush and detergent to completely and thoroughly clean the bowl. The utility brush of this invention is designed to quickly, efficiently and automatically clean toilet bowls without the necessity of using hand-held brushes. In addition to household use, the utility brush can be used in hotels, office buildings, plants and industry, schools, and in institutions, such as hospitals and nursing homes, and in all applications by janitorial and maid services.

2. Description of the Prior Art

No known automatic devices are available on the market or in the art to effect automatic cleaning of toilet bowls, although U.S. Pat. No. 3,599,246 to Angelo Bramati, et al, discloses a water closet seat cleaning device which utilizes a chain arranged in a closed loop and a sweeper means secured to the chain to clean toilet seats.

Accordingly, it is an object of this invention to provide a new and improved automatic device for cleaning toilet bowls, which device includes a motor-driven, shaped brush removably bracketed to the rim of a toilet bowl, with the brush extending into the bowl to rotatably clean the interior of the bowl.

Another object of this invention is to provide a new and improved, automatic toilet bowl brush which includes a housing containing a motor and having a tapered and shaped brush rotatably mounted to the motor shaft, which housing and brush can be removably bracketed to the rim of a toilet bowl of substantially any size and shape, with the brush extending inside the bowl to automatically clean the bowl.

Yet another object of this invention is to provide a new and improved rotatable brush mechanism or machine for cleaning toilet bowls which includes an electric motor enclosed within a motor housing, which motor is mounted in cooperation with a brush having a "stepped" or cone-shaped configuration to match the interior configuration of the toilet bowls, the housing being designed to removably mount on the rim of the bowls to effect quick, efficient rotatable cleaning of the interior of the toilet bowls.

A still further object of the invention is to provide a new and improved, rotatable, brush-mounted toilet bowl cleaner which includes a generally cylindrically-shaped housing having a motor mounted in the interior thereof and carrying a rotatable shaft and a brush extending downwardly of said housing and attached to the shaft, which housing is capable of being removably mounted on a toilet bowl with the brush projecting inside the bowl to rotatably clean the bowl upon activation of the motor.

Another object of the invention is to provide an automatic brush mechanism for cleaning toilet bowls, which brush mechanism is characterized by a housing, a motor and a cooperating timer for controlling trhe time of operation, the speed and/or the direction of rotation of a shaft and brush to clean the bowls.

SUMMARY OF THE INVENTION

These and other objects of the invention are provided in a new and improved utility brush which, in a preferred embodiment, is characterized by a generally cylindrically-shaped housing of high structural integrity carrying a motor and a cooperating timer, and a shaft projecting downwardly from the motor, to which shaft is removably attached a brush having a configuration generally in the shape of the interior of a toilet bowl. A bracket mounted to the housing is included for removably mounting the utility brush on the rim of a toilet bowl and projecting the brush into the bowl to effect rotatable cleaning of the bowl upon activation of the motor and timer.

BRIEF DESCRIPTION OF THE DRAWING

The invention will be better understood by reference to the accompanying drawings, wherein.

DESCRIPTION OF THE PREFERRED EMBODIMENTS

Figure 1:
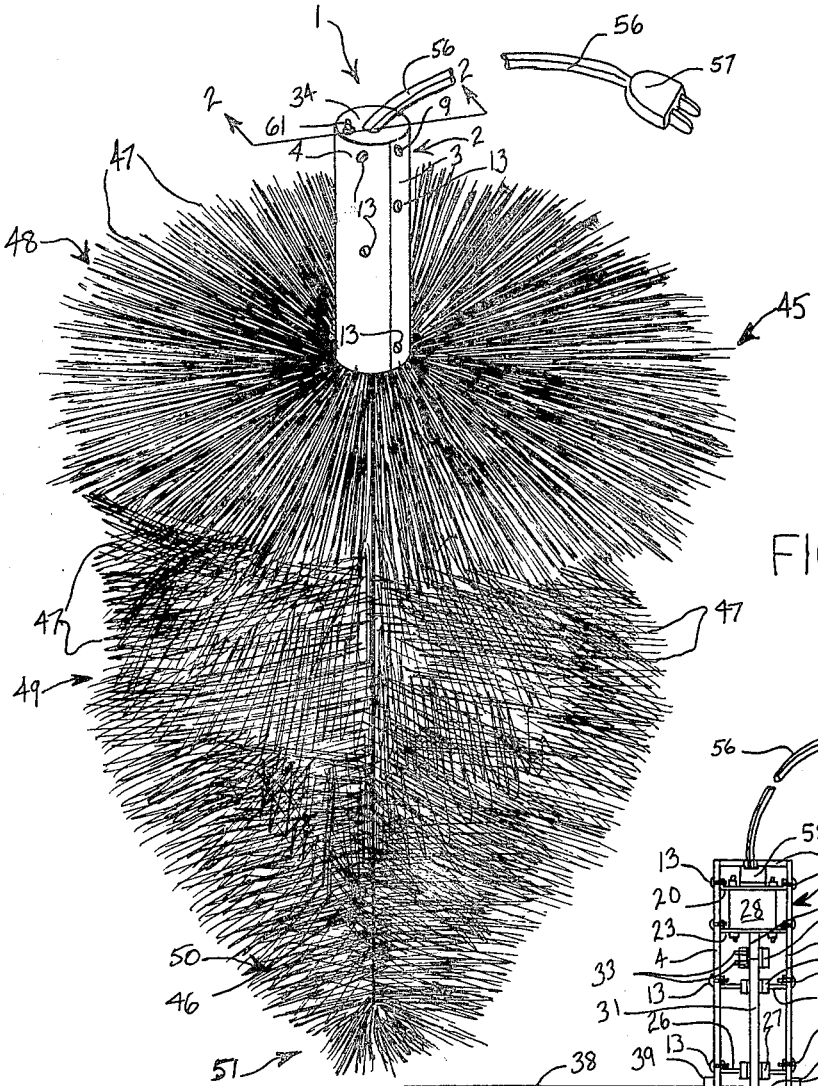
FIG. 1 is a perspective view, partially in section, of a preferred embodiment of the utility brush of this invention.

Referring now to FIG. 1 of the drawings, in a preferred embodiment of the invention the utility brush of this invention is generally illustrated by reference numeral 1, and includes a housing 2, characterized by a first housing segment 3 and a second housing segment 4 in mating relationship. First housing segment 3 and second housing segment 4 are removably joined by a plurality of flange screws 9, and are closed at the top by a housing top 34, which serves to support an electric cord 56, with a plug 57, emerging from housing top aperture 35. A switch 61 serves to initiate and terminate the flow of electric current through electric cord 56 and plug 57. A brush generally illustrated by reference numeral 45 is generally configured to fit the interior of a toilet bowl by the shaping of bristles 47 into a top bristle cluster 48; a middle bristle cluster 49; a lower bristle cluster 50; and a bottom bristle cluster 51, as illustrated. The multiple bristles 47 are carried by a common brush shaft 46, which extends beneath housing 2 of utility brush 1.

Figure 2:
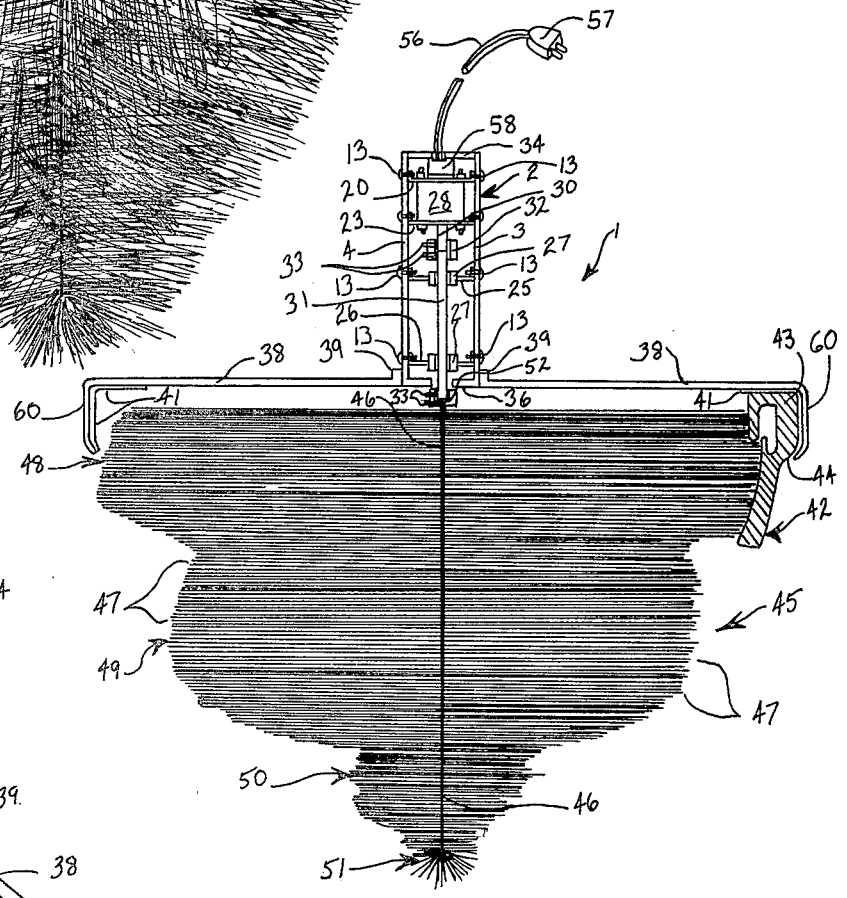
FIG. 2 is a sectional view taken along lines 2—2 of the utility brush illustrated in FIG. 1, more particularly illustrating the brush mounted in functional position on the rim of a toilet bowl.
Figure 3:
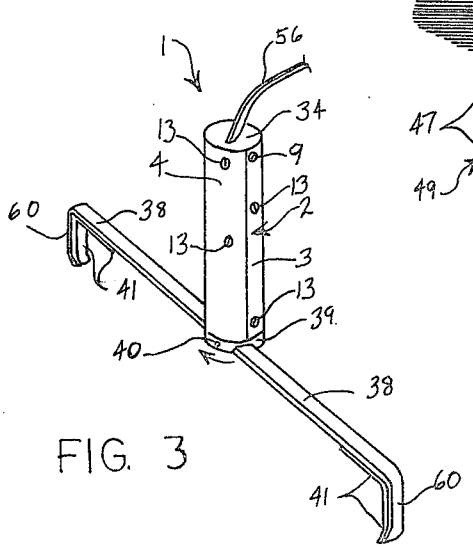
FIG. 3 is a perspective view of the utility brush illustrated in FIGS. 1 and 2 with a mounting bracket attached.

Referring now to FIGS. 2 and 3 of the drawings, in a preferred embodiment of the invention a mount bracket 38 is secured to housing 2 by means of a mount bracket collar 39, and a collar set screw 40, which can be adjusted to position mount bracket 38 in a 360° arc on housing 2, as desired. Mount bracket 38 is further provided with downwardly extending exterior flanges 60, each carrying a mount bracket pad 41 for engagement with the toilet bowl rim 43 of toilet bowl 42, at toilet bowl rim neck 44, as illustrated in FIG. 2. The projection of brush 45 into toilet bowl 42 is illustrated in FIG. 2, with top bristle cluster 48 in close proximity to the top interior surface of toilet bowl 42 to insure thorough and complete cleaning of inside of the bowl rim.

Figure 4:
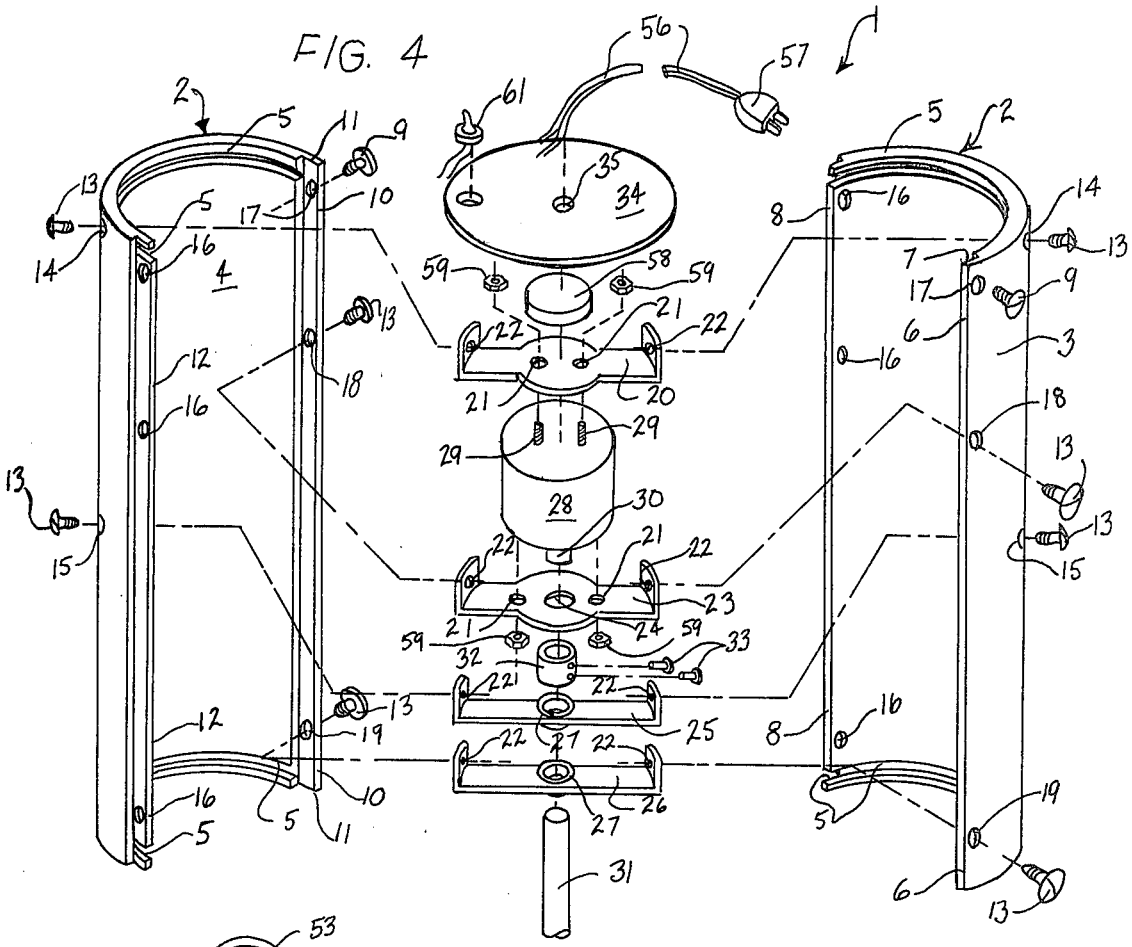
FIG. 4 is an exploded view of a preferred embodiment of the utility brush illustrated in FIGS. 1–3.
Figure 5:
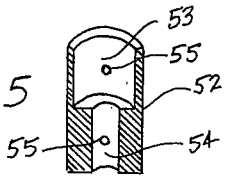
FIG. 5 is a sectional view, taken along lines 6—6 in FIG. 4, of a preferred brush shaft coupling for removably mounting the brush shaft to the main shaft.
Figure 5:
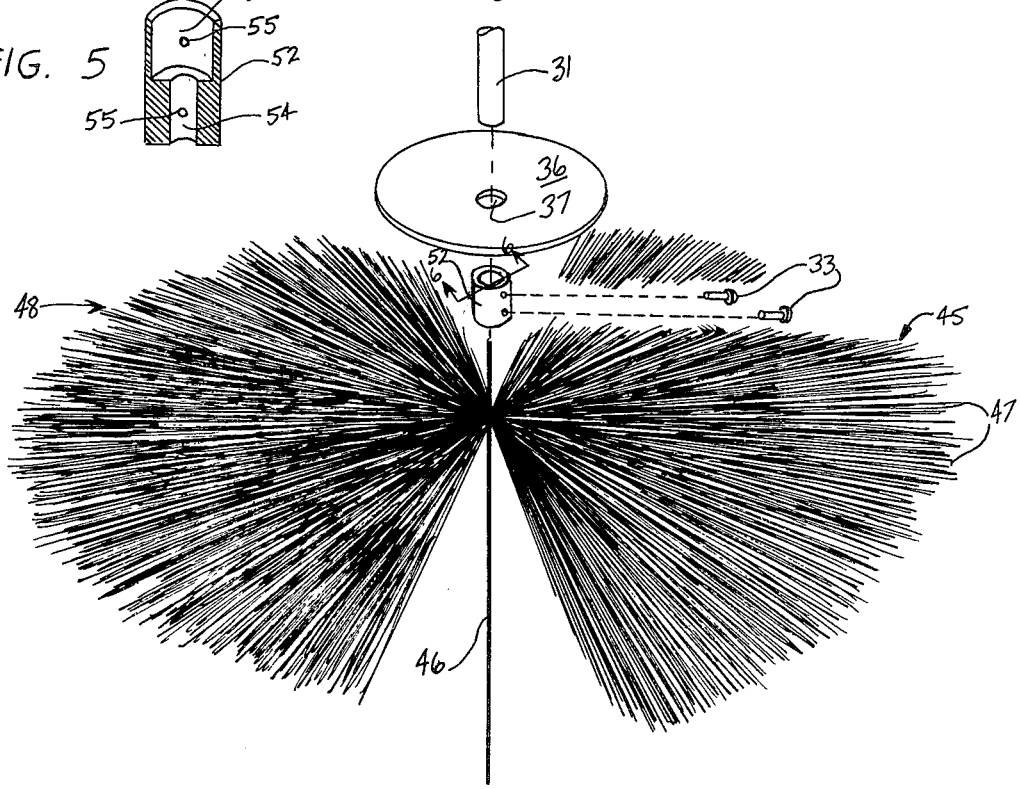

Referring now to FIGS. 2, 4 and 5, in a preferred embodiment of the invention first housing segment 3 and second housing segment 4 are each shaped to provide a first housing segment flange 6 on first housing segment 3, and a second housing segment flange 10 on second housing segment 4. First housing segment flange 6 defines a first housing segment seat 7, while second housing segment flange 10 shapes a second housing segment seat 11, as illustrated. On the opposite edges of first housing segment 3 and second housing segment 4, respectively, are provided a first housing segment edge 8 on first housing segment 3, and a second housing segment edge 12, on second housing segment 4. Accordingly, when first housing segment 3 is joined to second housing segment 4 as illustrated in FIGS. 1, 2 and 3, first housing segment flange 6 fits against second housing segment edge 12 as second housing segment edge 12 registers with first housing segment seat 7. Furthermore, second housing segment flange 10 matches with first housing segment edge 8 as first housing segment edge 8 registers with second housing segment seat 11. Housing top 34 is designed to register with segment slots 5 provided in the top of first housing segment 3 and second housing segment 4, while housing bottom 36, provided with housing bottom aperture 37, fits in registration with the segment slots 5 provided at the bottom of first housing segment 3 and second housing segment 4, respectively. First housing segment 3 and second housing segment 4 are then joined by flange screws 9 which, in a preferred embodiment, are threaded, and cooperate with matching threaded edge apertures 16, provided in first housing segment edge 8 and second housing segment edge 12, and top flange apertures 17 in first housing segment flange 6 and second housing segment flange 10. A motor 28 is provided inside housing 2 with motor shaft 30 maintained in registration with a shaft 31 and a brush shaft 46 by means of a top motor bracket 20, a lower motor bracket 23, an upper shaft bracket 25 and a lower shaft bracket 26. Lower motor bracket 23 is fitted with a motor shaft aperture 24 to accommodate shaft 31, and motor 28 is mounted to top motor bracket 20 and to lower motor bracket 23 by means of motor bolts 29, which extend through motor bolt apertures 21, and cooperating nuts 59. Shaft 31 is removably attached to motor shaft 30 of motor 28 by a motor shaft coupling 32, which is provided with a pair of set screws 33, as illustrated. Furthermore, shaft 31 is maintained in axial alignment inside housing 2 by means of a pair of shaft bushings 27, provided in both upper shaft bracket 25 and lower shaft bracket 26, respectively. Top motor bracket 20, lower motor bracket 23, upper shaft bracket 25 and lower shaft bracket 26 are anchored to first housing segment 3 and second housing segment 4 of housing 2 in off-set, staggered fashion by means of bracket screws 13, which project through holes or apertures in housing 2 and engage threads formed in bracket screw apertures 22. For example, top motor bracket 20 is secured to first housing segment 3 and second housing segment 4 by means of a pair of bracket screws 13 projecting through top housing apertures 14 and threadably engaging top motor bracket 20 through bracket screw apertures 22. Similarly, lower motor bracket 23 is removably affixed to first housing segment 3 and second housing segment 4 by means of a second pair of bracket screws 13 which project through middle flange apertures 18. Likewise, upper shaft bracket 25 is mounted to first housing segment 3 and second housing element 4 by means of a pair of bracket screws 13 which are inserted through middle housing apertures 15. Furthermore, lower shaft bracket 26 is mounted to first housing segment 3 and second housing segment 4 by means of a pair of bracket screws 13 which are fitted through bottom flange apertures 19 and engage bracket screw apertures 22.

Referring now specifically to FIG. 5 of the drawings, in a preferred embodiment of the invention brush shaft 46 is removably coupled to shaft 31 by means of a brush shaft coupling 52 which is provided with an internal shaft bore 53 large enough to accommodate sahft 31, and a brush shaft bore 54 which is smaller than shaft bore 53 and yet is sufficiently large to accommodate the somewhat smaller brush shaft 46. In this manner brush shaft 46 can be securely, yet removably, coupled to a larger shaft 31 by tightening or removing a pair of set screws 33 threadably cooperating with threaded set screw apertures 55 It will be appreciated that a "quick release" button or mechanism can be provided as deemed necessary to remove brush shaft 46 from shaft 31 and/or brush shaft coupling 52, according to the knowledge of those skilled in the art.

Referring again to FIGS. 2 and 4 of the drawings, an electric cord 56, having a conventional plug 57 extends through housing top aperture 35, and is wired to motor 28 through a switch 61 in conventional fashion. However, in a preferred embodiment of the invention the electric cord 56 is wired to motor 28 through a timer 58, which permits utility brush 1 to be operated in one or more timed sequences of selected duration, according to the degree of cleaning necessary. It will be appreciated that motor 28 may be of either fixed or variable speed and the motor speed may be controlled either manually through a multiple position switch 61, or automatically, with or without the use of a timer 58, according to the knowledge of those skilled in the art. Accordingly, timer 58 can be used simply to stop motor 28 after a preset cleaning cycle, or it can be utilized to activate one or more timed cleaning sequences, including clockwise and counter-clockwise rotation of motor 28.

In another preferred embodiment of the invention utility brush 1 is provided with a cover or shroud (not illustrated) which may be split or otherwise designed to fit over the toilet bowl 42 and brush 45 in order to permit brush 45 to rotate at relatively high speed for more intense and thorough cleaning. The cover permits high brush speeds without splashing water from toilet bowl 42.

It will be recognized that brush 45 can be quickly and easily removed from shaft 31 for drying, storage or replacement by simply loosening one of set screws 33 and sliding brush shaft 46 or shaft 31 from brush shaft coupling 52, or activating an alternative "quick-release" mechanism, as heretofore described. Furthermore, shaft 31 can be removed from motor shaft coupling 32 by loosening the lower one of set screws 33 and disengaging shaft 31, after first housing segment 3 and second housing segment 4 are removed. If it is desired to remove shaft 31 from motor shaft coupling 32 without removing first housing segment 3 and second housing segment 4, a hole can be provided in either first housing segment 3 or second housing segment 4 for insertion of a screwdriver or other tool to facilitate loosening of one of set screws 33.

In operation, utility brush 1 is assembled as illustrated in FIGS. 2–4 with mount bracket 38 in position on first housing segment 3 and second housing segment 4. Brush 45 is then placed inside toilet bowl 42 and flanges 60 of mount bracket 38 are fitted over toilet bowl rim 43, with mount bracket pads 41 in secure contact with bowl rim 43, as illustrated in FIG. 2. It will be appreciated that bracket 38 can be adjustable, if desired, to fit toilet bowl rims of varying size, according to the knowledge of those skilled in the art. A cleaning agent and/or disinfectant can then be added to the water in the bowl, and the plug 57 inserted in the wall outlet. Switch 61 may then be manipulated to the desired motor speed which is a matter of choice for one skilled in the art, or to the timer sequence position, and a cover may be used if relatively high rotational brush speeds are desired.

It will be further appreciated by those skilled in the art that housing 2 of utility brush 1 is, in a preferred embodiment formed of aluminum in order to provide a high degree of structural integrity and corrosion resistance with little weight. However, it will be understood that other materials such as fiberglass, plastic and the like may be used to construct housing 2, according to the knowledge of those skilled in the art. Furthermore, in yet another preferred embodiment, brush 45 is designed in a generally cone-shaped configuration, with bristles 47 of substantially medium stiffness and of varying length in the top bristle cluster 48, middle bristle cluster 49, lower bristle cluster 50 and bottom bristle cluster 51, in order to facilitate folding of the longest bristles 47 in each respective cluster and contact of the shorter bristles 47 in the clusters with the inside surfaces of a relatively small toilet bowl.

Having described my invention with the particularity set forth above, what is claimed is:

1. A utility brush comprising:

(a) a housing and a motor contained in said housing;

(b) shaft means having one end cooperating with said motor in rotatable relationship in said housing;

(c) brush means characterized by a generally cone-shaped brush having multiple bristles arranged in a top bristle cluster having a first selected diameter; a middle bristle cluster having a second selected diameter; a lower bristle cluster having a third selected diameter; and a bottom bristle cluster having a fourth selected diameter, said brush means removably carried by the opposite end of said shaft means and projecting beneath said housing for insertion in a toilet bowl; and (d) mount bracket means attached to said housing and shaped to removably engage the rim of the toilet bowl and position said brush means rotatably in the toilet bowl.

2. The utility brush of claim 1 wherein said housing is a split housing and is characterized by a first housing segment and a cooperating second housing segment removably joined to said first housing segment, and further comprising a plurality of fasteners joining said first housing segment and said second housing segment.

3. The utility brush of claim 1 wherein said mount bracket means is characterized by a collar rotatably mounted on said housing and at least two outwardly extending arms carried by said collar and having downwardly extending flanges on the projecting ends of said arms for engagement with said rim of said toilet bowl.

4. The utility brush of claim 1 wherein:

(a) said housing is a split housing characterized by a first housing segment and a cooperating second housing segment removably joined to said first housing segment, and further comprising a plurality of fasteners joining said first housing segment and said second housing segment; and (b) said mount bracket means is characterized by a collar adjustably rotatably mounted on said housing and at least two outwardly extending arms carried by said collar and having downwardly extending flanges on the projecting ends of said arms for engagement with said rim of said toilet bowl.

5. The utility brush of claim 1 further comprising a timer in electrical cooperation with said motor for effecting at least one selected timed rotational sequence of said brush.

6. The utility brush of claim 1 wherein:

(a) said housing is a split housing characterized by a first housing segment and a second housing segment removably joined to said first housing segment, and further comprising a plurality of screws cooperating with said first housing segment and said second housing segment;

(b) said mount bracket means is characterized by a collar adjustably rotatably mounted on said housing and a pair of outwardly extending arms carried by said collar and having downwardly extending flanges on the projecting ends of said arms for engagement with the rim of said toilet bowl; and further comprising a timer in electrical cooperation with said motor for effecting at least one selected timed rotational sequence of said brush means.

7. A utility brush for automatically cleaning toilet bowls comprising:

(a) a generally cylindrically-shaped, split housing having a top and a bottom and characterized by a first housing segment and a second housing segment;

(b) a plurality of brackets mounted in spaced relationship to the inside of said housing;

(c) a motor carried by a first pair of said brackets in the upper interior of said housing with the motor shaft projecting downwardly;

(d) a shaft carried by a second pair of said brackets in rotatable relationship and having one end removably coupled to said motor shaft;

(e) a generally cone-shaped brush extending beneath said housing, and a brush shaft projecting from the top of said brush, and removably coupled to the opposite end of said shaft; and (f) mount bracket means having a collar adjustably rotatably mounted on said housing and a pair of outwardly extending arms having one end attached to said collar and downwardly extending flanges on the opposite projecting ends thereof, for engagement with said rim of the toilet bowls.

8. The utility brush of claim 7 further comprising a timer in electrical cooperation with said motor for effecting at least one selected timed rotational sequence of said brush in the toilet bowls.

* * * * *